US005480254A

United States Patent [19]

Autry et al.

[11] Patent Number: 5,480,254

[45] Date of Patent: Jan. 2, 1996

[54] STORM DRAIN BOX FILTER AND METHOD OF USE

[76] Inventors: James L. Autry, Rte. 8, Box 970, Fayetteville, N.C. 28304; Jimmy N. Whitley, 206 Breckenridge Dr., Knightdale, N.C. 27545

[21] Appl. No.: 154,527

[22] Filed: Nov. 19, 1993

[51] Int. Cl.[6] ..... E01C 11/22

[52] U.S. Cl. ..... 404/2; 210/163

[58] Field of Search ..... 404/2, 3, 4, 5; 210/163, 164, 165, 237, 282, 470, 484; 4/286, 289, 291, 292

[56] References Cited

U.S. PATENT DOCUMENTS

| | | | |
|---|---|---|---|
| 232,948 | 10/1880 | Dernham | 210/318 |
| 248,559 | 10/1881 | Jackson | 4/220 |
| 809,201 | 1/1906 | Lutz | 210/314 |
| 4,382,713 | 5/1983 | Kawahara | 404/4 |
| 4,419,232 | 12/1983 | Arntyr et al. | 210/164 |
| 5,133,619 | 7/1992 | Murfae | 404/4 |
| 5,284,580 | 2/1994 | Shyh | 210/163 |
| 5,290,457 | 3/1994 | Karbachsch et al. | 210/792 |

*Primary Examiner*—Ramon S. Britts
*Assistant Examiner*—Pamela A. O'Connor
*Attorney, Agent, or Firm*—John G. Mills and Associates

[57] ABSTRACT

This invention is a box filter used in conjunction with newly constructed storm drains and the like to prevent undesirable amounts of sediment and other debris carrier by storm runoff from entering the storm drain. Upper and lower frames are provided with expanded metal interior and exterior sidewalls extending therebetween. The box-like structure has an open bottom, reinforcing plates adjacent the connection of a lift handle and corner braces to add rigidity to the system. An aggregate such as crushed stone is placed between the interior walls and exterior walls of the filter and act as a filter media for the sediment of the debris. This filter is reusable without loss of its filtering qualities due to its rugged construction and back flushable filter medium.

9 Claims, 3 Drawing Sheets

STORM DRAIN BOX FILTER AND METHOD OF USE

FIELD OF INVENTION

This invention relates to environmental protection means and more particularly to sediment filters for storm runoff.

BACKGROUND OF INVENTION

Environmental protection regulations relating to disturbed earth and sediment carried by storm water runoff are stringent. Extensive use of stone riprap, fabric fences and sediment ponds have been used for this purpose. Also where ultimate filtration is needed to prevent sediment flow in critical areas such as around storm drains prior to road paving, bails of hay held in place by steel rods have been used successfully although these are very labor intensive to install and remove and are wasteful in that the hay bails can not be reused.

More specifically, during the construction of roads, parking lots and the like it is necessary to install the storm drains prior to final grading and paving at which point grates can be placed over the storm drain entrance and the water from the paved areas can flow thereinto. From the time that storm drains are initially constructed until the paving of adjacent areas can be weeks and even months. During this time mud, silt and other debris from the surrounding unpaved areas must be prevented from entering the storm drains or the same will become clogged and rendered useless.

To prevent the ingress of sediment and debris carrying storm runoff after the construction of the storm drain prior to paving of the area, bails of hay have been placed around the storm drains and held in place with steel rods driven into the ground to prevent the same from floating away. This method of protecting storm drains from ambient sediment and debris during storm runoffs is very labor intensive, the hay bails are subject to rapid deterioration, particularly when left for several months and must be discarded after use.

Concise Explanation of References

The following references represent the closest prior art of which the inventor is aware:

U.S. Pat. No. 5,133,619 to Murfae et al discloses a storm water filtration system with a removably mounted basket installed in a base, said basket being filled with washed coarse gravel. This is a permanent installation with the basket being removable using the tines of a conventional waste disposal vehicle.

U.S. Pat. No. 248,559 to Jackson discloses a narrow box or cage filled with a media, said box having walls through which a fluid can flow. It should be noted that the fluid in this case is gaseous and the media is a disinfectant material.

U.S. Pat. No. 4,382,713 to Kawahara is an apparatus for reducing wastage for water draining from pavements by letting storm runoff move into a container filled with pebbles or foam concrete so that the water can be disbursed into the underlying ground.

U.S. Pat. No. 819,201 to Lutz is considered of interest in that it discloses a receiving basin having coarse stone or gravel in the bottom thereof to strain water being discharged.

U.S. Pat. No. 4,419,232 to Arntyr et al and 232,948 to Dernham are both considered of general interest in that they disclose catch baskets used in association with sewers.

BRIEF DESCRIPTION OF INVENTION

After much research and study into the above mentioned problems, the present invention has been developed to provide a simple and yet highly efficient means of preventing sediment and debris from entering a storm drain during the construction process and prior to the area being paved.

This filter means will not deteriorate even when left in place over extended periods of time and can be used an unlimited number of times by simply removing from the storm drain after paving has occured, backflushing the filter media and placing the same on the next newly constructed storm drain to protect the same prior to ambient paving.

The above is accomplished through the provision of a box-like structure having side walls and end walls, the exterior dimensions being basically the same as the exterior dimensions of the storm drain the filter box is used in conjunction with. The storm drain box is double willed with channel iron forming the top the bottom frames with the inside and outside walls being formed from expanded metal and filled with one inch or smaller crushed stone.

Once the storm drain has been constructed, the storm drain box filter of the present invention is simply placed on the top of the storm drain and left there until such time as the surrounding area has been paved. At that time it is simply lifted off the storm drain, the standard grate placed thereon and the filter moved to the next job. During this latter process, it can be backflushed if desired to remove sediment that has collected in the stone filter media.

In view of the above it is an object of the present invention to provide a reusable means for preventing water born sediment and debris from entering newly constructed storm drains.

Another object of the present invention to provide a storm drain filter in the form of a double walled, open bottom box with a filter media disposed between said double walls.

Another object of the present invention is to provide a storm drain filter box having double walls with the same being filled with crushed stone.

Another object of the present invention is to provide a filter box for storm drains that is constructed of double walled, expanded metal between which is disposed crushed stone of one inch diameter or smaller.

Another object of the present invention is to provide a box-like, double walled filter storm drain that is reusable.

Other objects and advantages of the present invention will become apparent and obvious from a study of the following description and the accompanying drawings which are merely illustrative of such invention.

DETAILED DESCRIPTION OF INVENTION

Figure 1:
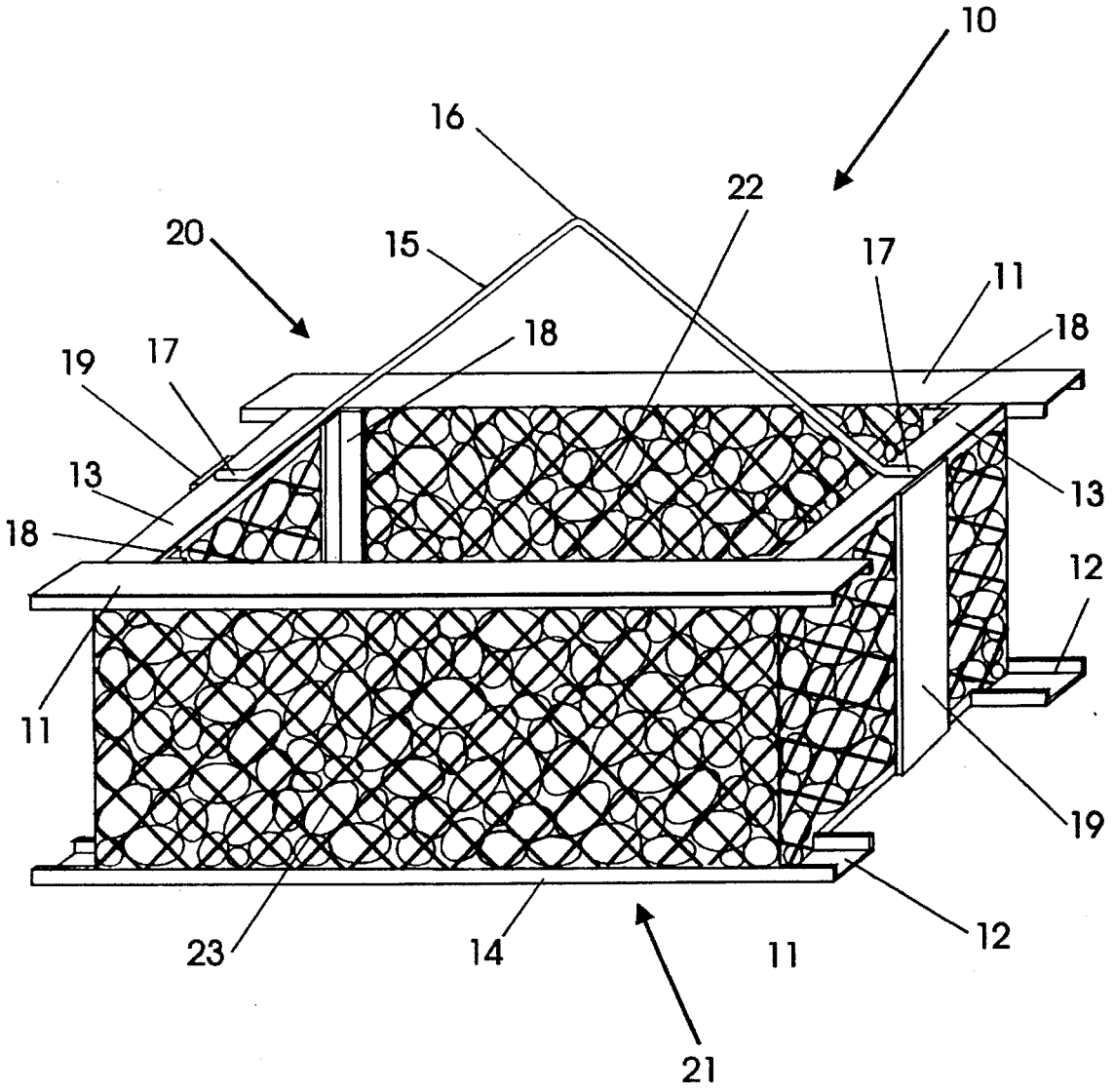
FIG. 1 is a perspective view of the storm drain filter box of the present invention.

With further reference to the drawings, the storm drain box filter of the present invention, indicated generally at 10, includes a pair of parallely disposed upper side channel members 11 and a pair of parallely disposed lower side channel members 12.

Interconnecting the parallel upper side channel members are a pair of parallely disposed upper end channel members 13 connected to tile said side channel members by weldment or other suitable means. Also a pair of parallely disposed lower end channel members 14 interconnect the lower side channel members 12 and are secured thereto by weldment or other suitable means.

A lift handle 15 is provided and is inverted V-shaped in configuration with an apex 16 in the center thereof. The ends of the lift handle 15 of are flared, as indicated at 17, so they are in axial alignment and are secured to the center of parallely disposed upper end channel members by weldment or other suitable means as can clearly be seen in the drawings.

Connecting the upper side and end channels 11 and 13 to the lower side and end channels 12 and 14 are corner braces 18 made of angle iron or similar material and welded or otherwise secured to the interior corners thereof.

Reinforcing plates 19 are secured by weldment or other means to the center portion of upper end channel members 13 and lower end channel members 14. These reinforcing plates assure that when the storm drain box filter 10 of the present invention is lifted by handle 15, the weight is evenly distributed between the upper channel members forming an upper frame, indicated generally at 20, and the lower channel members forming a lower frame, indicated generally at 21.

A porous interior wall 22 interconnects the inner edges of the upper frame 20 and the lower frame 21. It has been found that expanded metal works well for this purpose and can be secured to the receptive frames by weldment or other suitable means.

A porous exterior wall 23, similar to wall 22, is also provided and is disposed parallel to the interior wall and is secured to the outer edges of the upper frame 20 and the lower frame 21.

In constructing the storm drain box filter of the present invention, the lower frame 21 is welded together and the interior and exterior walls are then secured thereto. The corner braces can also be put in place if desired. The space between the interior and exterior walls is then filled with a filter media such as crushed stone, preferably having a diameter of one inch or less.

Once the void between the interior and exterior walls has been filled, the upper frame 20 can be put in place over interior and exterior walls 21 and 22. The corner braces 18 and reinforcing plates 19 can then be welded thereto thus forming a box filter with the filtering media such as crushed stone being permanently encapsulated therein.

Storm drains, indicated generally at 24, are built to exacting standards and have predetermined exterior sizes and interior openings. Storm drains are, of course, connected to underground pipes that carry the water away from the drain for disposal in an acceptable manner.

The storm drains, of course, have to be built in the early stages of construction before final grading and paving of the area is completed.

Figure 2:
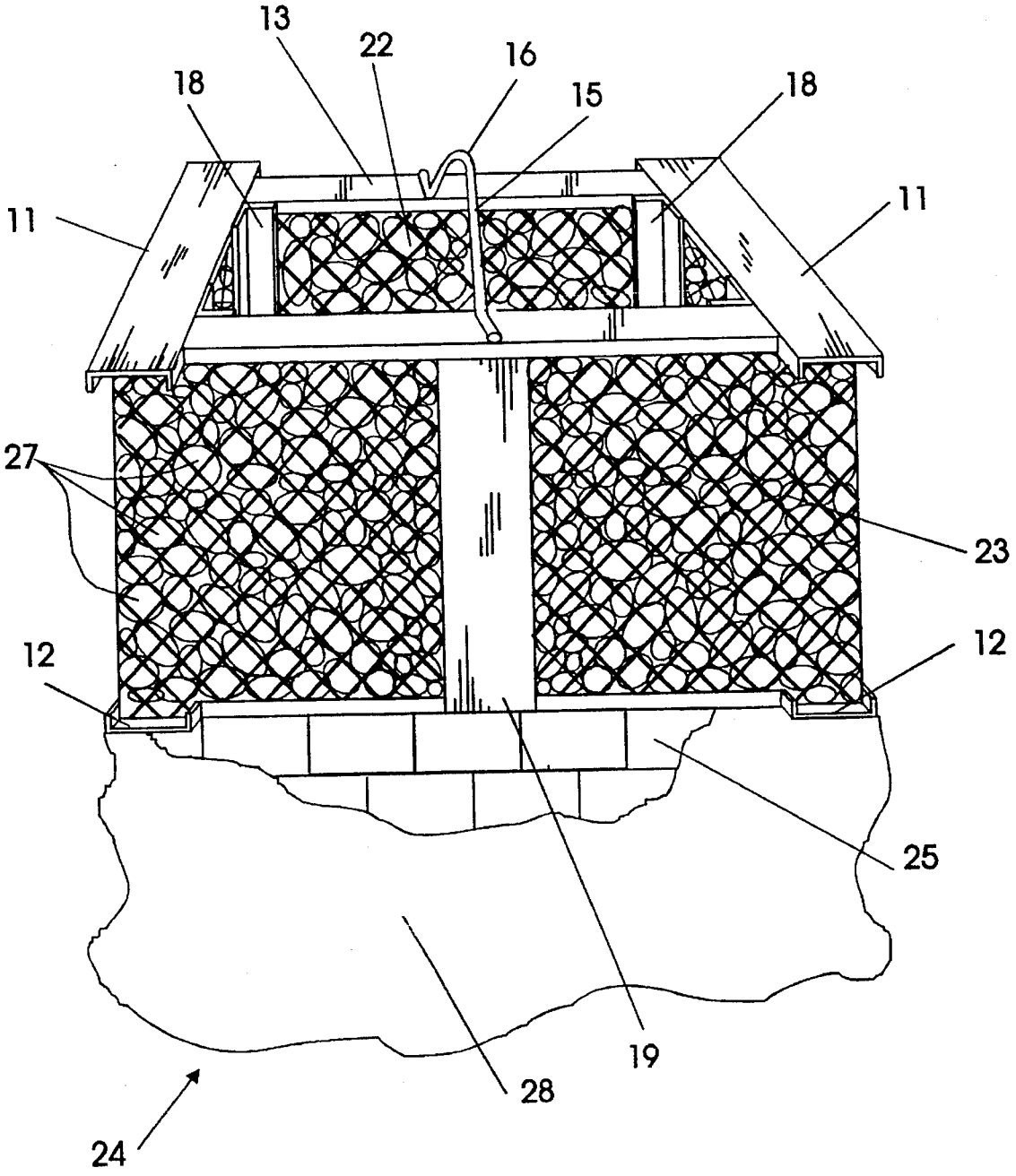
FIG. 2 is a perspective view of the present invention mounted on a storm drain prior to paving of the adjacent surrounding area.
Figure 3:
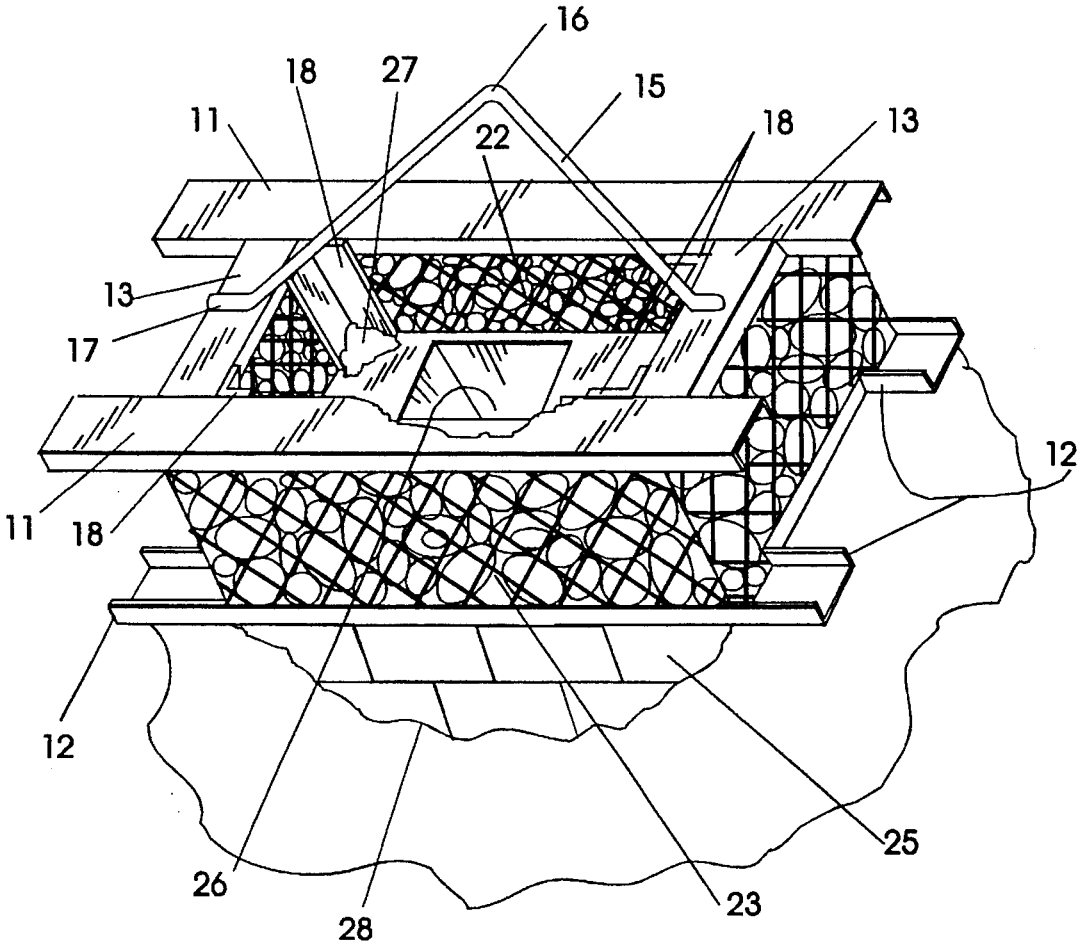
FIG. 3 is a perspective view of the interior of the filter on the storm drain.

The exterior dimensions of the storm drain box filter 10 of the present invention are the same as the dimensions of the exterior 25 of the storm drain 24. As soon as the storm drain 24 is completed, the box filter 10 is placed on top thereof as can clearly be seen in FIG. 2.

The disturbed earth 28 around the storm drain 24 is prevented from being carrier by storm water into the interior opening 26 of said storm drain by the aggregate 27 which will filter out the sediment while allowing the storm water to pass therethrough.

Devices constructed in accordance with the present invention have been left in place on storm drains for extended periods of time including several months between the initial storm drain construction and paving of the adjacent or ambient area with no sediment buildup in the interior 26 of said storm drain.

Once the adjacent area up to the exterior 25 of the storm drain has been paved, the storm drain can be removed by simply picking it up by lift handle 15 and placing it on a truck or other conveyance. If desired, the aggregate 27 between the interior and exterior walls 22 and 23 can be back flushed to remove deposited sediment and debris therefrom before the filter is reused on another newly constructed storm drain prior to the adjacent area being paved.

Since there are no moving parts to the box filter of the present invention, it can be used over and over again without its useful life being diminished.

From the above it can be seen that the present invention provides a highly efficient, reusable filter for newly constructed storm drains and similar areas needing sediment protection and is relatively inexpensive due to the fact that it can be reused over and over again without diminishing its effectiveness. The present invention is also simple to construct and use and yet is sturdy and is extremely efficient in controlling storm water runoff.

The terms "upper", "lower", "top", "bottom" and so forth have been used herein merely for convenience to describe the present invention and its parts as oriented in the drawings. It is to be understood, however, that these terms are in my way limiting to the invention since such invention may obviously be disposed in different orientations when in use.

The present invention may, of course, be carrier out in other specific ways than those herein set forth without departing from the spirit and essential characteristics of such invention. The present embodiments are, therefore, to be considered in all respects as illustrative and not restrictive, and all changes coming within the meaning and equivalency range of the appended claims are intended to be embraced therein.

What is claimed is:

1. A regenerable filter means in combination with a storm drain, said filter means preventing undesirable amounts of sediment and other debris from entering said storm drain prior to paving of adjacent areas comprising: a frame means having peripheral wall means, an open bottom and an open top, said frame means including a pair of rectangular, upper and lower frame portions being vertically opposed in parallel, spaced apart relation, said upper and lower frame portions being fabricated from channel members, each of said channel members within said upper frame portion facing inwardly toward each of said channel members within said lower frame portion and being arranged to receive said peripheral wall means therebetween, said frame means further including corner braces interconnecting said upper and lower frame portions at the corner junctures thereof and being disposed in perpendicular relation thereto, said peripheral wall means including permeable, interior and exterior walls being permanently retained between said upper and lower frame portions and being arranged in parallel spaced-apart relation within said channel members defining a space therebetween;

a crushed stone filter aggregate disposed in said space between said interior and exterior walls; and means for lifting said filter means for disposing the same on said storm drain whereby said filter means is positioned on top of an opening in said storm drain at the surface of an unpaved road enabling sediment and debris laden water flowing from said surface of said unpaved road to be filtered before entering said storm drain.

2. The filter means of claim 1 wherein the lift means is a lift handle attached to said box.

3. The filter means of claim 1 wherein said interior and exterior walls are formed from expanded metal.

4. The filter means of claim 1 wherein the means for lifting said filter is a lift handle attached to said upper frame.

5. The filter means of claim 1 wherein reinforcing plates extend between said upper frame and said lower frame adjacent the attachment of the means for lifting said filter.

6. The filter means of claim 1 wherein said filter aggregate is composed of crushed stone having a diameter of ½", to 1½".

7. The method of filtering sediment laden water on an unpaved road adjacent a newly constructed storm drain using a regenerable, filter means having an open bottom, an open top and spaced apart permeable interior and exterior walls containing a crushed stone filter aggregate disposed in space between said interior and exterior walls and means for lifting said filter means for disposing the same on a storm drain comprising:

positioning said regenerable filter means on a storm drain at the surface of an unpaved road;

introducing a flow of sediment laden water to the area adjacent said storm drain on the surface of said road;

filtering said storm water through said permeable walls of said filter means;

directing the filtered water through said open bottom of said filter means into said storm drain;

removing said filter means from said storm drain when it has become saturated with sediment;

flushing said filter means to remove the retained sediment;

reclaiming the sediment collected by said filter means for further use; and repositioning said filter on said storm drain for continued use.

8. The method of claim 7 wherein the step of filtering is carried out by a process of adhesion of said sediment to said crushed stone aggregate.

9. The method of claim 8 wherein the step of flushing further includes passing a reverse flow of water through said interior walls of said filter means in an outward direction to remove deposited sediment.

* * * * *